United States Patent [19]

Prohaska

[11] Patent Number: 4,638,911

[45] Date of Patent: Jan. 27, 1987

[54] PACK AND PROCESS FOR THE MANUFACTURE THEREOF

[75] Inventor: Helmut Prohaska, St. Polten, Austria

[73] Assignee: Folienwalzwerk Brueder Teich Akitenesellschaft, Obergrafendor Muhlhofen, Austria

[21] Appl. No.: 736,476

[22] Filed: May 21, 1985

Related U.S. Application Data

[63] Continuation of Ser. No. 261,157, Apr. 20, 1981, abandoned.

[30] Foreign Application Priority Data

Jun. 19, 1980 [AT] Austria ..... 00017/80

[51] Int. Cl.[4] ..... B65D 17/34

[52] U.S. Cl. ..... 206/611; 206/484; 206/628

[58] Field of Search ..... 206/484, 608, 610, 611, 206/612, 613, 628

[56] References Cited

U.S. PATENT DOCUMENTS

| | | | |
|---|---|---|---|
| 2,322,594 | 6/1943 | Russell | 206/613 |
| 2,909,312 | 10/1954 | Conerty | 206/628 |
| 3,013,712 | 12/1961 | Wollaeger | 206/612 |
| 3,069,273 | 12/1962 | Wayne | 206/628 |
| 3,159,303 | 12/1964 | Betner | 206/628 |
| 3,215,333 | 11/1965 | Stelzer | 206/628 |
| 3,291,377 | 12/1966 | Eggen | 206/613 |
| 3,362,617 | 1/1968 | Gieber | 206/613 |
| 3,770,185 | 11/1973 | Reeves | 206/628 |

*Primary Examiner*—Stephen P. Garbe

*Attorney, Agent, or Firm*—Bierman & Muserlian

[57] ABSTRACT

A pack for packaging articles having a tear-open member (7) and consisting of a flexible and foldable packaging material having a doubled region in which said packaging material is formed of two layers (4,5) bonded to each other with a bonding agent and on which the beginning of the tear-open member is located, the said two layers of packaging material and tear-open member being optionally bonded to one another in a gas-tight manner, the region surrounding the tear-open member being substantially completely encircled by lines of weakness in the packaging material and optionally to the edge of the doubled region.

2 Claims, 2 Drawing Figures

PACK AND PROCESS FOR THE MANUFACTURE THEREOF

This is a continuation, of Ser. No. 261,157 filed Apr. 20, 1981, now abandoned.

TECHNICAL FIELD

The invention relates to a pack, particularly a sachet pack, for the packaging of packaged articles, with a wrapping having a tear-open member and consisting of a two-dimensional, flexible and foldable packaging material, the packaging material having at least one doubled region, in which the said packaging material forms layers which are bonded two-dimensionally to one another by means of a bonding agent, and on which the start of the tear-open member is located. The invention also relates to an advantageous process for the manufacture of a sachet pack of this type.

STATE OF THE ART

Packs of the abovementioned type are used, in particular, for the packaging of solid articles, such as baked goods having a relatively long storage life, chocolates, etc. The operation of opening the wrapping is started by pulling-off the tear-open member; the slit-shaped opening which is thereby obtained in the wrapping material is then enlarged, by further tearing-open of the wrapping material or by deforming the wrapping, until the packaged articles can be removed from the wrapping.

If the tear-open member is formed, for example, by a tear-open strip, this is usally made on the inside of the pack wrapping between two lines of weakness of the packaging material. The start of the tear-open strip is therefore located at a position of a doubled region of the packaging material between the layers of packaging material, which are bonded to one another in this region by sealing. Known packs of this type are not gas-tight, at least at this abovementioned position.

STATEMENT OF THE INVENTION

The object of the invention is to provide a pack with a wrapping having a tear-open member, the said wrapping consisting of a two-dimensional, flexible and foldable packaging material, the packaging material having at least one doubled region, in which said packaging material forms two layers which are bonded two-dimensionally to one another by means of a bonding agent, and on which the start of the tear-open member is located, and in which pack operation of the tear-open member is facilitated by means of simple measures and the pack can be made gas-tight, even at the positions where the tear-open member starts.

The object of the invention is, furthermore, to provide an advantageous process for the manufacture of packs according to the invention or of the packaging material used for these packs.

The object on which the invention is based is achieved in the pack according to the invention, which is characterized in that the region, occupied by the tear-open member, of that layer of packaging material of the doubled region which merges into the wrapping part bonded to the tear-open member, lies opposite a region which is located in the other layer of packaging material of the doubled region and is enclosed at least almost completely by lines of weakness of the packaging material and, optionally, by the edge of the doubled region, the tear-open member and the two layers of packaging material being optionally bonded two-dimensionally to one another in this doubled region by means of a bonding agent.

By means of the particular nature of the line of weakness, it is ensured that regions which are bonded to the start of the tear-open member or which adjoin same, in both layers of packaging material of the doubled region, can easily be separated from the pack wrapping when the tear-open member is pulled off, and thus permit or facilitate this pulling-off. If, now, a gas-tight bond exist between the two layers of packaging material and the tear-open member—for example, by means of a seal—than the pack is gas-tight even at this point.

According to an advantageous embodiment of the pack according to the invention, the doubled region of the layers of packaging material, which are bonded to the tear-open member by means of a bonding agent, is one of the fins of a sachet pack which is provided with two fins and is known per se.

The object on which the invention is based is achieved, furthermore, in the process according to the invention for the manufacture of the sachet pack according to the invention, the said process being characterized in that a continuous tear-open member is provided or applied on the web of sealable packaging material employed, this web being provided with lines of weakness in its longitudinal direction, the said tear-open member being located, if appropriate, between two lines of weakness and being applied before the sachet pack is produced in a manner known per se. In this case, the web of packaging material employed advantageously has, as a sealing layer, a coating of cold-bonding adhesive, onto which a tear-open strip, which is coated on one side with a cold-bonding adhesive, is hot-laminated, as a tear-open member, on its side without cold-bonding adhesive, by means of a thermoplastic bonding agent.

The object on which the invention is based is achieved, finally, in an advantageous embodiment of the process according to the invention, which is characterized in that, to produce the web of packaging material employed, which is provided with lines of weakness, a web-shaped carrier layer is provided, along the positions of the lines of weakness provided, with perforations at least over discrete sections and is thereafter bonded to a non-perforated web-shaped proofing layer which is covered, in turn, with a sealing layer.

Figure 1:
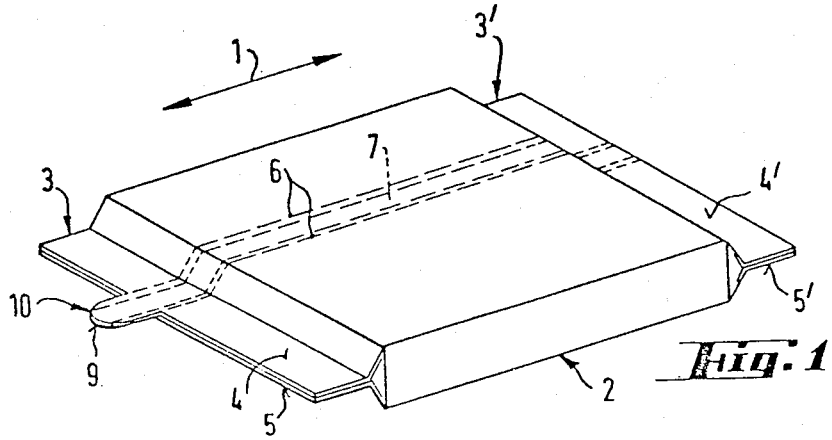
FIG. 1 illustrates diagrammatically a sachet pack of the type according to the invention.

The sachet pack is produced, in a manner known per se, by a process in which the continuously fed web of packaging material, which has lines of weakness at predetermined points or a tear-open strip applied to the sealing layer and running between two such lines of weakness in the longitudinal direction of the web, is folded in the packaing machine, in this longitudinal direction 1 (FIG. 1), around the article to be packaged, for example bars of chocolate, and a sachet-shaped wrapping 2 which encloses the packaged article is formed by the production of a longitudinal sealing seam (not shown in the Figure), the said wrapping being divided into individual packs by transverse sealing seams 3, 3' and by severing the packaging material at these seams. These transverse sealing seams 3,3' produce fin-shaped doubled regions at the pack ends, at each of which regions two layers of packaging material 4, 5 and 4', 5' respectively are bonded two-dimensionally to one another. The layers of packaging material 4, 4' which come to lie on the upper side of the pack (in FIG. 1) merge into the upper part of the pack wrapping, on the inside of which a tear-open strip 7 is applied between two lines of weakness 6 of the packaging material. Bridges are provided between the perforations made over discrete sections on the lines of weakness. The start 9 of the tear-open strip 7 is located on the underside of a tab-shaped extension 10 of the layer of packaging material 4 in the doubled region of the transverse sealing seam 3 and runs in its sealing region between the layers of packaging material 4 and 5. In this case, the layers of packaging material 4 and 5 and the tear-open strip 7 are bonded to one another two-dimensionally and in a gas-tight manner by means of the seal. Such a two-dimensional and gas-tight bonding of the tear-open strip 7 to the lower layer of packaging material 5 has not been known hitherto in sachet packs of this type.

To facilitate the tearing, the start of the tear-open strip is designed in a special way.

Figure 2:
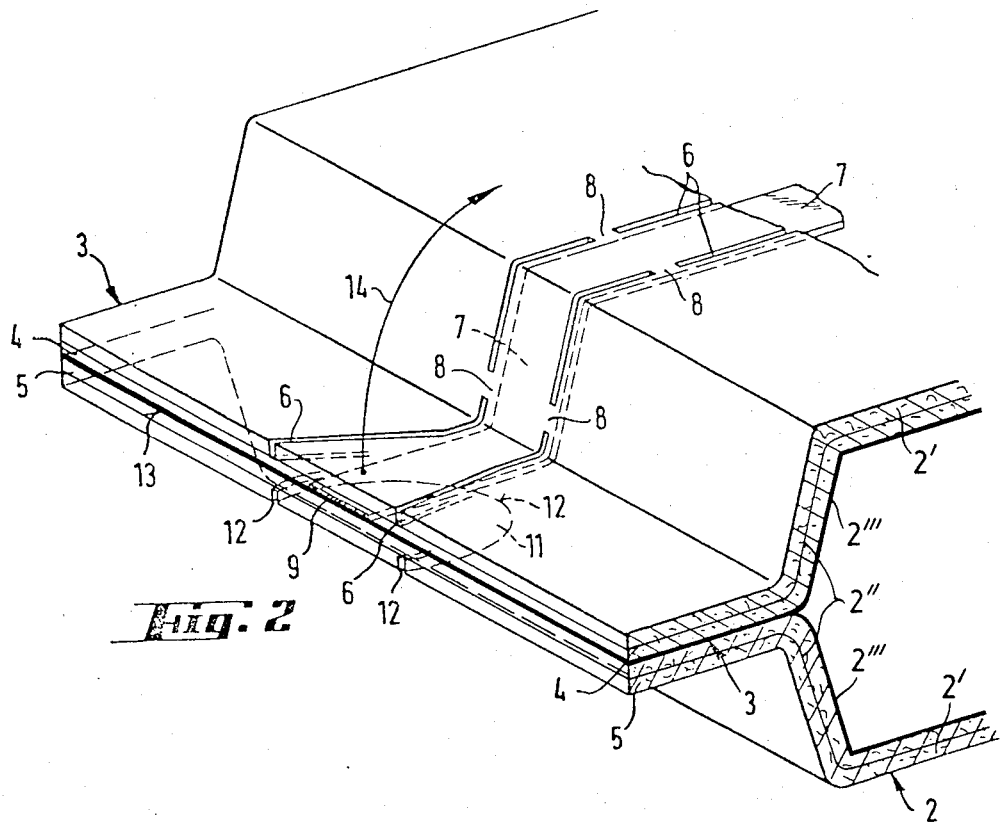
FIG. 2 illustrates diagrammatically a sachet pack in a partial view wherein the start of the tear-open strip has no tab-shaped extension.

FIG. 2 illustrates a sachet pack in a partial view which shows diagrammatically such a special design of the start of the tear-open strip, which has, in contrast to FIG. 1, no tab-shaped extension. The carrier layer 2' is perforated at the lines of weakness and the proofing layer 2'' and the sealing layer 2''' illustrate that a small thickening is provided at the doubled region of the packaging at the exposed edge 13 at the beginning of start 9 of the tear open strip 7 which is interposed between layers 4 and 5.

The start of the tear-open strip is located on the doubled region which is produced from the layers of packaging material 4 and 5 by means of a transverse sealing seam. The tear-open strip 7, which is applied to the inside of the part of the pack wrapping (at the top in FIG. 2) or of the layer of packaging material 4, lies between two lines of weakness 6 of the packaging material, on which the bridges 8 between the perforations can be seen, these lines of weakness running parallel to one another over the major part of the pack, but diverging from one another in a wedge-shaped manner within the layer of packaging material 4. The region which is bounded, in the (upper) layer of packaging material 4' by these lines of weakness 6, lies opposite a region 11 which is located in the (lower) layer of packaging material 5 and is enclosed by a U-shaped line of weakness 12 and by the edge 13 of the doubled region.

To tear the tear-open strip, the start of the tear-open strip is grasped, in the region 11 of the doubled region formed by the two layers 4 and 5, and is pulled upwards in the direction of the arrow 14. In so doing, the region 11 of the layer of packaging material 5 bonded two-dimensionally and in a gas-tight manner to the start 9 of the tear-open strip 7, is parted at the U-shaped line of weakness 12 and the lines of weakness 6, located on both sides of the tear-open strip, are torn out from the edge 13 of the doubled region. The pack is then opened, as usual, by further pulling-off the tear-open strip.

THE BEST WAY TO PUT THE INVENTION INTO PRACTICE

Two examples of sachet packs according to the invention are given below.

EXAMPLE 1

To manufacture a web of packaging material forming the pack according to the invention, a glazed paper web, which is coated on one side and has a weight per unit area of 60–100 g/m$^2$, is employed, this paper web being provided simultaneously, in a rotary printing machine, with a surface decoration print and with perforations over discrete sections along the lines of weakness provided on the packaging material. A tape-shaped aluminum foil having a thickness of 0.008 to 0.012 mm is then coated on one side with a laminating medium and is laminated onto the printed paper web which possesses lines of weakness. This composite product is finally coated with a cold-bonding adhesive on the side facing away from the paper web.

As a tear-open strip, a thin polyethylene tape, which is provided on one side with a cold-bonding adhesive coating, is applied, with its side without cold-bonding adhesive, to the web of packaging material thus produced. This is effected, for example in the manufacture of sachet packs, by hot-laminating the polyethylene tape, in the longitudinal direction of the web of packaging material, onto the cold-bonding adhesive coating of the web of packaging material fed to the packaging machine, using a thermoplastic bonding agent, such as, for example, wax.

In contrast thereto, in the production of known sachet packs, the tear-open strip is applied transversely to the web of packaging material, that is to say, in particular, perpendicularly to its longitudinal direction, for which purpose very expensive mechanical measures, which are avoided in the process according to the invention, are required in the packaging machine.

The further steps in the production of sachet packs then take place as described with reference to FIG. 1, the sealing seams to be made being effected by cold-sealing.

EXAMPLE 2

The packaging material to be employed according to this Example differs from that described in Example 1, in that, instead of the paper web, a plastic web is employed, in particular a regenerated cellulose web having a weight per unit area of 28–40 g/m$^2$, and, instead of the cold-bonding adhesive coating, a polyethylene-based hot-melt adhesive coating is employed. A polyester tape, which is provided on both sides with a polyethylene hot-melt adhesive coating, serves as a tear-open strip, this polyester tape being hot-sealed onto the hot-melt adhesive coating of the packaging material.

The sachet packs are again produced as described with reference to FIG. 1, the sealing seams being made in the form of hot seals, in contrast to Example 1.

COMMERCIAL USEFULNESS

The pack according to the invention can be advantageously employed primarily as a pack for foodstuffs such as chocolates or baked goods having a relatively long storage life, and can be produced either in a gas-tight design or in the form of sachet packs, as desired. However, in such cases, its commercial usefulness is not restricted to packs for packaged articles of a solid nature.

I claim:

1. Pack for the packaging of articles to be packed with a wrapping having a tear-open member and consisting of a thin flexible and foldable packaging material, the packaging material having at least one double region with an exposed edge in which said packaging material forms two layers bonded to one another with a bonding agent and on which the start of the tear-open member is located, one of said layers being an extension of a part of the wrapping in which the tear-open member is located, characterized in that the thin packaging material, having lines of weakness formed in the material before formation of the pack, comprises a carrier layer which is provided along said lines of weakness with perforations at least over discrete sections and a non-perforated proofing layer which is bonded to the carrier layer and which is covered, in turn, with a sealing layer comprising the bonding agent, that the tear-open member is located between lines of weakness in the packaging material and that the layer (4) of the double region which is the extension of the wrapping part in which the tear-open member is located has a portion within which the start of the tear-open member is located and which lies opposite a region (11) located in the other layer (5) of the double region, this region (11) being encircled at least almost completely by lines of weakness (12) of the packaging material of this other layer (5) and an exposed straight edge of the double region (13), the two packaging layers being sealed together on their non-perforated proofing layers.

2. Pack according to claim 1 characterized in that the double region of the layers of packaging material (4,5) in which the start of the tear-open member (7) is located is one of the fins (3) of a sachet pack which is provided with two fins (3,3').

* * * * *